United States Patent [19]

Mori et al.

[11] Patent Number: 4,897,179

[45] Date of Patent: Jan. 30, 1990

[54] METHOD OF PRODUCING REDUCED IRON AND LIGHT OIL FROM ION ORE AND HEAVY OIL

[75] Inventors: Kenji Mori; Katsuhiko Tsuzura, both of Kobe; Mamoru Onoda, Hyogo; Ryo Watanabe, Kobe; Takehiko Ashie, Kobe; Yoshifumi Kameoka, Kobe; Katsufumi Shinohara, Kobe; Atsuhiko Nakanishi, Hyogo, all of Japan

[73] Assignee: Jyushitsuyu Taisaku Gijutsu Kenkyukumiai, Tokyo, Japan

[21] Appl. No.: 931,988

[22] Filed: Nov. 25, 1986

Related U.S. Application Data

[63] Continuation of Ser. No. 760,579, Jul. 30, 1985, abandoned.

[30] Foreign Application Priority Data

Aug. 3, 1984 [JP] Japan ..... 59-163950

[51] Int. Cl.[4] ..... C10G 11/12; C10G 11/18

[52] U.S. Cl. ..... 208/127; 208/157; 208/121

[58] Field of Search ..... 208/121, 124–126, 208/127, 157, 164; 75/29, 26, 33, 34; 423/148, 658

[56] References Cited

U.S. PATENT DOCUMENTS

| | | | |
|---|---|---|---|
| 2,760,855 | 8/1956 | Barking et al. | 75/29 X |
| 3,097,156 | 7/1963 | Johnson et al. | 208/124 |
| 3,264,209 | 8/1966 | Files, II et al. | 208/124 |
| 3,895,936 | 7/1975 | Toepell | 75/29 X |
| 4,224,140 | 9/1980 | Fujimori et al. | 208/124 |
| 4,298,460 | 11/1981 | Fujimori et al. | 208/121 |
| 4,325,812 | 4/1982 | Fujimori et al. | 208/121 X |
| 4,334,920 | 6/1982 | Mori et al. | 208/124 X |

FOREIGN PATENT DOCUMENTS

| | | | |
|---|---|---|---|
| 47708 | 4/1979 | Japan | 208/121 |

*Primary Examiner*—Glenn Caldarola

*Attorney, Agent, or Firm*—Oblon, Spivak, McClelland, Maier & Neustadt

[57] ABSTRACT

A method of producing reduced iron and light oil from iron ore and heavy oil which comprises a thermal cracking step of subjecting heavy oil to thermal cracking while retaining iron ore particles in a fluidized state to produce light oil and simultaneously to deposit coke as by-product on the surface of the iron ore particles; a gasification step of putting the coke-deposited ore in contact with an oxidizing gas including steam and oxygen in a fluidized state to react the coke with the gas thereby to produce a reducing gas containing hydrogen and carbon monoxide and of heating the coke-deposited ore upward of a reduction temperature of iron ore by partial oxidization of the coke; and a reduction step of reducing the coke-deposited iron ore in a fluidized state by the reducing gas to produce reduced iron. When the gasification step is performed by an oxidizing gas containing a majority of steam and up to 15 vol. %, based on the steam, of oxygen at 800°–1000° C. under a pressure of 0–10 kg/cm$^2$ G, a reducing gas containing high-concentration hydrogen gas is obtained.

13 Claims, 3 Drawing Sheets

METHOD OF PRODUCING REDUCED IRON AND LIGHT OIL FROM ION ORE AND HEAVY OIL

This application is a continuation, of application Ser. No. 760,579, filed July 30, 1985, now abandoned.

BACKGROUND OF THE INVENTION

1. Field of the Invention

This invention relates to direct method of iron manufacture which comprises subjecting heavy oil to thermal cracking in a fluidized bed of iron ore particles as a fluid medium to recover light oil distillates thereby to convert the heavy oil toward declining in demand to light oil in a great demand and at the same time, reducing iron ore by reducing agent of a carbonaceous material, i.e. petroleum coke deposited as by-product on the surface of the iron ore upon cracking to produce reduced iron. More particularly, it relates to a method of producing reduced iron and light oil from iron ore and heavy oil wherein petroleum coke deposited on the iron ore undergoes gasification in a fluidized bed by an excessive amount of steam and a small amount of oxygen to obtain high-concentration hydrogen gas.

2. Description of the Related Art

Nowadays, the balance of supply and demand of petroleum products is in the situation that global trend of supply is toward heavy-gravity crude oil, and hence yield of heavy oil from crude oil is increasing year by year. Conversely, owing to skyrocketing rise in petroleum price conversion from petroleum to coal and LNG has been encouraged and particularly, the conversion into coal and LNG has been positively promoted in a fuel field easily susceptible of conversion into coal and LNG, namely, in a major consumption field of fuel oil such as iron and steel, cement, electric power, etc. and consequently, the demand for heavy oil tends toward decrease remarkably. On the other hand, with a light oil such as kerosene, gas oil, its demand tends toward expanding steadily both in civil use and industrial use in spite of the fact that its yield from crude oil is on the decrease. As a consequence, the demand-and-supply balance of petroleum products has a tendency toward oversupply of heavy oil and supply shortage of middle distillates such as kerosene, gas oil, etc. The gap between demand and supply of them is estimated to amount to twenty million kl/year in 1990. For this reason, an urgent important problem is to obviate the supply-and-demand gap by converting the surplus heavy oil into light oil. This problem is true not only in our country, but throughout the world.

As regards reduced iron, the demand of it is expected to be active mainly in developing countries and reduced iron plants are still now being constructed in succession mostly in petroleum producing countries. However, these plants for the production of reduced iron utilize natural gas as a source of reducing agent, and hence, their location is inevitably limited to natural gas producing districts.

A direct reduction method of iron manufacture is advantageous in that scale merits are not pursued unlike blast furnace iron manufacture method. Accordingly, the direct reduction method is economically practical as a small-scale ironworks even in such districts that market scale is small and it is inconvenient to transport products. However, in the present situation where natural gas is used as a reducing agent, the foregoing advantage inherent in the direct reduction method for iron manufacture is not sufficiently exhibited.

In view of the foregoing problems, in order to solve simultaneously both the problem of demand-and-supply gap of petroleum products and the problem of location of reduced iron plants as described above, the present invention is designed for utilizing heavy oil having a worldwide tendency toward oversupply as a source of reducing agent for the production of reduced iron and at the same time, for producing light oil, e.g., kerosene, gas oil, having a global tendency to supply shortage by submitting heavy oil to thermal cracking.

On the other hand, gasification technology for converting solid energy such as hydrocarbons or carbonaceous materials, e.g., petroleum coke into gaseous state which is easy to use has been investigated for many years in many countries, and several gasification furnaces were put into practice.

Then, in an era when petroleum resources are available in abundance, however, the gasification technology as a fuel technology has nearly lost its significance and only a few gasification furnaces still remain on stream.

In the latter half of 1970s, the petroleum oil crisis has struck a serious blow at the entire world economy and gasification technology of coal, coke, etc. again came to prominence. On the other hand, demand for heavy oil such as fuel oil which have been a cheap energy source and consumed in large quantities has declined rapidly, and the trend toward light oil including middle oil and light oil is predominating among petroleum products. Heavy oil is therefore directed at recovering middle and light oils by cracking. One such recovery methods is thermal cracking process which is widely practiced. Carbonaceous material or petroleum coke which is produced by thermal cracking from heavy oil is of little utility value where the material contains a substantial amount of sulfur ingredient in it, and effective utilization of petroleum coke present in an amount of 10–20% in heavy oil has been desired.

This invention has been accomplished to meet technological and economic requirements as described above.

A primary object of this invention is therefore to provide a new process of producing reduced iron and light oil from iron ore and heavy oil as raw material which process comprises a combination of: a step of subjecting heavy oil to thermal cracking in thermal medium of iron ore to recover light oil fractions and to deposit coke produced as a by-product on the iron ore surface, a step of gasifying the coke thus deposited with steam and oxygen to make a reducing gas including CO and $H_2$, and a step of reducing the iron ore by the reducing gas to produce reduced iron (This process will be hereinbelow simple referred to as the KKI process.).

A particular object of this invention is, in the KKI process above, to produce a reducing gas necessary for reduction of iron ore by gasification of coke.

Another particular object is, in the KKI process, to adjust, during a gasification step, the amount of coke deposited on the iron ore upon thermal cracking to an amount suitable for subsequent reduction step by oxidization of it.

A further particular object is, in the KKI process, to supply the reduction step with heat by feeding the coke-deposited iron ore which is heated by heat evolution due to oxidation of the coke.

Another primary object of this invention is, in the KKI process, to obtain high-concentration hydrogen gas by putting the coke-deposited iron ore in contact with an oxidizing gas containing an excessive amount of steam, in the gasification step.

SUMMARY OF THE INVENTION

An essential feature of this invention for attaining the foregoing objects resides in a method of producing light oil from heavy oil by subjecting heavy oil to thermal cracking in a fluid medium of iron ore particles and concurrently, depositing coke obtained as by-product from the heavy oil on the surface of iron ore particles, gasifying the coke thus deposited with steam and oxygen to make a reducing gas including hydrogen and carbon monooxide, and reducing the iron ore by the use of the reducing gas to produce reduced iron.

Another feature of this invention consists, in the aforesaid method (KKI process), in a method for obtaining high-concentration hydrogen gas by gasification of coke, which method is characterized in that the coke-deposited iron ore particles are introduced into a fluidized bed gasification furnace, where the coke is brought into contact with an oxidizing gas containing an excessive amount of steam to oxygen at a temperature of 800°–1000° C. and reacted.

The invention will be hereinbelow described in more detail with reference to the accompanying drawings.

DESCRIPTION OF THE INVENTION

Figure 1:
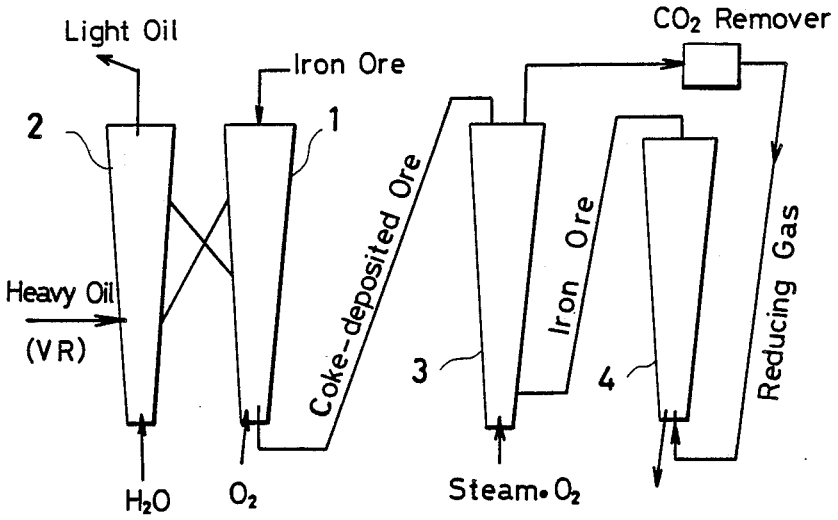
FIG. 1 is a flow sheet showing an outline of KKI process according to this invention.

In the KKI process shown in FIG. 1, the thermal cracking step of heavy oil is conducted in two-column fluidized beds, namely an iron ore-heating column 1 and a thermal cracking column 2 for heavy oil. The iron ore is adjusted to an average particle size of 10 μm–2 mm, preferably 20–300 μm and fed to the heating column 1, where it is heated at 600°–700° C. and then circulated into the thermal cracking column 2, thus forming a fluidized bed.

Heavy oil in the thermal cracking column 2 undergoes catalytic cracking by high-temperature iron ore and gaseous light oil produced is separated from the column top and petroleum coke produced as a by-product is deposited on the iron ore particles. The iron ore particles coated with the petroleum coke are circulated into the heating column 1 and there, a portion of the coke is burned to become a heat source. When the amount of deposited coke reaches 10–40 wt. %, the coke-deposited iron ore is discharged from the heating column 1 and fresh iron ore particulate material corresponding to it is replenished in the heating column 1.

The coke-deposited iron ore discharged is then fed to a fluidized bed gasification furnace 3 and acts as fluid medium. The coke is subjected to gasification by steam. The gasification reaction is shown in the formula:

$$C+H_2O \rightarrow CO+H_2 \quad (1)$$

and equimolar amounts of CO and $H_2$ are evolved. Since this reaction is endothermic, it is also possible to burn a portion of coke by oxygen or air to supply it with heat as shown in the formula:

$$C+O_2 \rightarrow CO_2 \quad (2)$$

That is, $CO_2$ gas is evolved. At higher temperature, the following solution loss reaction further takes place and CO increases amount evolved gases:

$$CO_2+C \rightarrow 2CO \quad (3)$$

Under high pressure, $H_2$ produced causes the following methanation reaction to produce $CH_4$:

$$C+2H_2 \rightarrow CH_4 \quad (4)$$

$$3H_2+CO \rightarrow CH_4+H_2O \quad (5)$$

and $H_2$ is thus consumed.

The reducing gas thus produced is delivered from the gasification furnace 3, decarbonated in a $CO_2$ remover and thereafter fed to a reduction furnace 4, where it reduces the iron ore particles which are supplied from the gasification furnace 3 and form a fluidized bed.

The coke-deposited ore, immediately when introduced in the gasification furnace, has a coke amount on the order of 10–40%, but most of the coke is consumed during gasification to the extent that amount of the coke deposited on the ore upon discharging and transferring to the next step is on the order of 4–6%.

The ore-heating temperature in the gasification furnace is required to be higher than the reduction temperature in subsequent step. When the reduction temperature is 800° C. the ore is desired to be heated upward of 800° C., more preferably at 850°–900° C. When the reduction temperature is 850° C., it is desirable to be heated at 900°–950° C.

Thus, in the gasification furnace 3, the coke deposited on the ore is gasified to produce a reducing gas, simultaneously with which the coke amount is adjusted to 4–6% as mentioned above and the coke-deposited ore is heated at about 800°–1000° C.

Then, the coke-deposited iron ore thus heated is transferred through a line to a reduction furnace 4 while retaining the high temperature.

In the reduction furnace 4, the aforesaid ore is reduced in a fluidized state by the reducing gas which is sufficiently heated upward of the reduction temperature in a gas-heating furnace (not shown) and admitted through a line to the reduction furnace, to produce reduced iron. It is discharged from a line and delivered to a hot briquetting equipment (not shown), where the reduced iron is shaped to briquets to avoid oxidation of it and facilitate handling of it.

Fluid reduction process per se is well known. According to the prior art process, iron ore itself is fed to a fluid reduction furnace, where as the reduction of the ore proceeds, reduced iron just produced sticks together in a sintered state and assumes a massive form (sticking phenomenon). The sticking phenomenon was avoided by lowering the reduction temperature, which resulted in a slow reduction rate and a long dwell time of the ore in the reduction furnace. As a consequence, a large-size reduction furnace or a multiple-stage reduction furnace in which a plurality of furnaces are arranged in series was required and the reaction temperature of it was at most 800° C.

In contrast, according to the method of this invention, the iron ore in a fluid state is coated on its surface with coke and also when the reduction proceeds and the iron ore is converted into reduced iron, reduced iron thus obtained is coated with coke on the order of 1–3%. Because of this, the sticking phenomenon hardly occurs, which allows the reduction temperature to be raised above 800° C. Hence, the merits are that a large reaction rate can be obtained and the reduction furnace can be made small-sized.

Conventional gasification furnace for coal caused mainly the foregoing reaction (1)–(5), and CO concentration in the evolved gases was high an $H_2$ concentration was suppressed to a relatively low level.

Table 1 given below shows the composition of gas products in representative commercial gasification furnaces, from which it will be generally apparent that CO concentration is high and $CO_2$ concentration is relatively low.

TABLE 1

Existing Gasification Furnaces (Operation Results)

| Furnace Name | Lurgi | Winkler | Koppers-Totzek | C I | Wellmann-Galusha | Texaco |
|---|---|---|---|---|---|---|
| Country developed | W. Germany | W. Germany | W. Germany | Italy, W. Germany, UK, France | USA | USA |
| Number of Instalation | 60 odd | 30 odd | 50 odd | ca. 100 | 2 or 3 | Demonstration plant 3 |
| Type of Furnace Bed | Fixed Bed | Fluidized bed | Jet bed | Fixed bed | Fixed bed | Fluidized bed |
| Pressure | Atmospheric-25 atm | Atmospheric | Atmospheric | Atmospheric | Atmospheric | 400–100 atm |
| Max. Scale (t/D) | 750 | 700 | 750 | 90 | 80 | 15 |
| Raw Material Coal | Sub-bituminous coal | Brown coal | Bituminous coal | Sub-bituminous coal | Bituminous coal | |
| Gasifying Agent | $O_2$ + steam (pressurized) | $O_2$(air) + steam | $O_2$ + steam | Air + Steam | Air + Steam | Water slurry + $O_2$ |
| Gas composition (%) | | | | | | |
| $H_2$ | 58.8 | 33.3 | 28.0 | 49.8 | 15.0 | 33 |
| CO | 20.3 | 29.3 | 54.4 | 28.4 | 28.6 | 55 |
| $CH_4$ | 20.0 | 2.6 | 0.1 | 6.5 | 2.7 | 0.01 |
| $C_mH_n$ | 0.8 | — | — | 0.8 | — | — |
| $N_2$ | 3.0 | 16.9 | 3.6 | 5.1 | 50.3 | 0.6 |
| $CO_2$ | 2.0 | 17.8 | 13.8 | 9.3 | 3.4 | 11 |
| Gas Calorific Value (kcal/$Nm^3$) | 4220 | 2150 | 2550 | 3140 | 1510 | |
| Produced Gas Amount ($Nm^3$/t) | 880 | 1670 | 1370 | 1660 | ca. 3000 | |

When a reducing gas having such a high CO concentration is used as a reducing agent in the process, carbon is deposited as shown in the formula:

$$4CO \rightarrow 2CO_2 + 2C$$

and causes clogging of pipings of plant. This reaction becomes active with higher pressure. Accordingly, a gas having a high $H_2$ concentration as far as possible is desirable as reducing agent.

In the present situation where demand for hydrogen is rapidly increasing in a variety of chemical industries, particularly as a raw material gas, clean energy in petroleum industry, etc., production of reducing gas containing a majority of hydrogen by gasification affords largely increased economic merits in these processes. To that end, the foregoing second feature of this invention is adopted. That is, in the fluidized bed gasification furnace 3, the coke-deposited iron ore particles are put in contact with an oxidizing gas containing a majority of steam and a slight amount of oxygen at a temperature of 800°–1000° C. Here, the oxydizing gas is flowed through the fluidized bed at a superficial linear velocity of 20 cm–2 m/sec, preferably 30–80 cm/sec. Further, in order to supply the enthalpy loss due to the endothermic reaction of the coke and steam and to adjust the coke amount, the oxidizing gas is preferred to contain oxygen in an amount of up to 15 vol. % of the steam volume. A suitable oxidizing gas is, for example, composed of 90 vol. % of steam and 10 vol. % of oxygen.

The interior furnace pressure of the fluidized bed gasification furnace 3 is preferred to be 0–10 kg/$cm^2$ G, more preferably 3–10 kg/$cm^2$ G. If the pressure exceeds over the upper limit, hydrogen will be partly synthesized into $CH_4$ to lower the hydrogen concentration, whereas if the pressure is too low, the amount of steam capable of being fed in the reaction system will be limited, which decreases the production output of gas. Therefore, in order to ensure substantial gas production output and suppress the production of $CH_4$, it is desirable that the pressure is in a range of 3–10 kg/$cm^2$ G.

The interior temperature of the gasification furnace 3 must be retained at 800°–1000° C. to ensure efficient production of the reducing gas. If the temperature is below 800° C., the reaction rate of the water gas production becomes small. If it is above 1000° C., not only is that disadvantageous in respect of energy cost, but also sticking phenomenon will occur, that is, the iron ore particles will be melt-bonded together and moreover, there is a danger for the petroleum coke to be burned away owing to oversupply of oxygen, which leads to an obstacle to the subsequent step.

As the heavy oil which is as a raw material applicable to this invention, even such poor-quality vacuum distillation residue as used for fluid coking process can be used, because there is no need of inhibiting production of coke as by-product in thermal cracking step. Examples of such heavy oil further include solvent extraction residue oil from dehydrator, thermal cracking residue oil, catalytic cracking residue oil, heavy gas oil, vacuum distillation gas oil and such crude oils as used for fluid coking process or fluid catalytic cracking (FCC) process. Further, oil water substances obtained from coal, oil sand, shale oil, etc. can likewise be applied.

Iron ore to be used for this invention includes various kinds of iron ores usually used for iron manufacture, for example, from its chemical constituent, magnetite, hematite, pyrite, pyrrhotite, limonite, siderite, etc. and, from another classification, Kikuna type, Taberg type, Magnitnaya type, Bilbao type, Laterite type, Algoma type, Lake Superior type, Clinton type, Minette type, etc.

Now, the compositions of gases produced in the gasification process in the method of this invention will be described with reference to experimental data.

One example of such gas composition is shown in Table 2 given below.

TABLE 2

| Gas | Gas Composition $H_2$ | CO | $CO_2$ | $CH_4$ |
|---|---|---|---|---|
| dry % | 50.6 | 7.8 | 36.9 | 3.9 |

As will be apparent from above, $H_2$ value is the largest and $CO_2$ is much more than CO. This is because CO produced by water gas evolution reaction of equation (1) mentioned above further reacts with steam present in excess to be converted into $CO_2$, producing $H_2$ by the shift reaction shown in the formula:

$$CO+H_2O \rightarrow CO_2+H_2 \quad (6)$$

This reaction is known to be accelerated by catalytic effect due to the presence of iron component.

In usual gasification of coal or others, in order to heighten $H_2$ proportion, a reactor exclusively conducting the shift reaction of formula (6) is required to be separately installed rearwardly of the gasification furnace. In contrast, according to this invention, only the gasification furnace is sufficient since the coexistence of the iron ore particles in the gasification furnace 3 allows the shift reaction of formula (6) to proceed effectively and, as a result, to yield gases containing high $H_2$ proportion.

Figure 2:
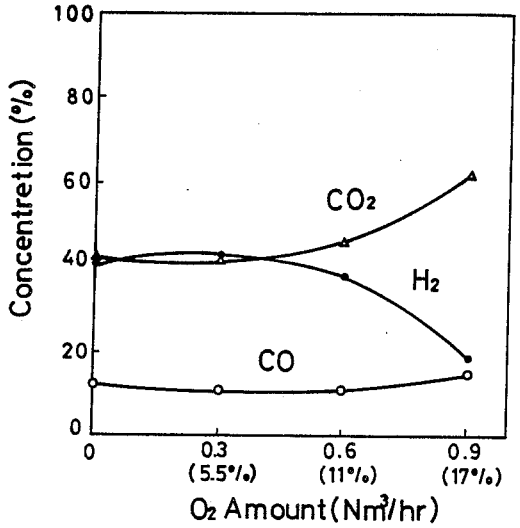
FIG. 2 and FIG. 3 are each a diagram showing experimental results of oxidization of petroleum coke by an oxidizing gas.

FIG. 2 shows compositions of gases produced in a pilot-plant gasification furnace when 5.5%, 11% and 17% of oxygen were respectively added to steam. As will be evident from it, $H_2$ concentration in the gas composition is maintained on a high level in oxygen amounts of up to 11%, whereas when the oxygen amount reaches 17%, $H_2$ concentration is remarkably decreased and $CO_2$ concentration is increased and consequently, it is not preferred from the object of producing reducing gas and the object of obtaining a high-concentration $H_2$.

Figure 3:
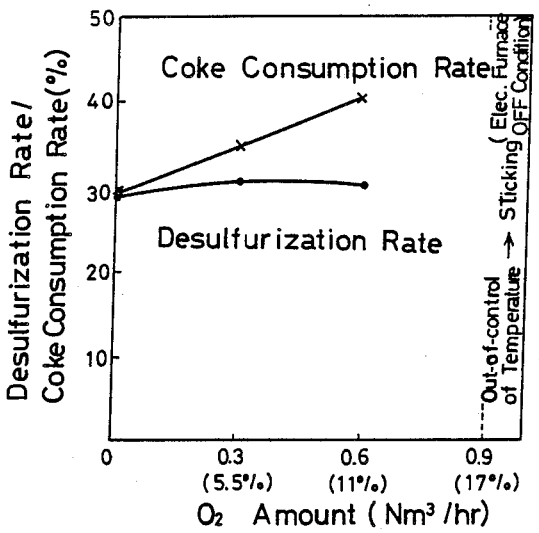

In FIG. 3, the coke consumption rate when oxygen was added to steam is shown, and it is apparent that as the amount of oxygen added increases the coke consumption rate increases steadily. Use of oxygen is therefore regarded as preferred insofar as its purpose is to adjust the coke amount in a short period of time. Further, use of oxygen is desirable also in the sense of replenishing calorific heat for the endothermic reaction of coke with steam. However, when oxygen is added in an amount of 17% of steam, the calorific amount exceeds over substantially the heat for supplying the endothermic reaction and the coke-deposited iron ore as fluid medium is overheated more than it needs, as a result of which it becomes difficult to control the temperature during fluidization, as confirmed by experiments. For this reason, addition amount of oxygen is required to be up to 15% of the amount of steam.

When a pilot plant was run by the present inventors under conditions of: 77 vol. % of steam, 3 vol. % of oxygen and a balance volume of nitrogen and a dwell time of 20 minutes, decrement of coke was a little more than 30% and reducing gas having a $H_2/CO$ ratio of 90/10 was obtained.

Thus, the catalytic action of iron ore in the coexistence with coke upon gasification of the coke and the action of steam excessively added accelerate the shift reaction to produce high-concentration hydrogen gas, which constitutes a feature of this invention.

In putting the iron ore and coke into coexistence, it is desirable to deposit the coke on the surface of the iron ore in a coating manner, but it is confirmed that simple mixing of iron ore and coke is also effective as shown in examples given below.

DESCRIPTION OF THE PREFERRED EMBODIMENTS

Example 1

In order to corroborate that shift reaction is conducted efficiently in the gasification furnace, gasification experiments by steam were performed in both cases of petroleum coke only and petroleum coke-deposited iron ore in a batch fluidized bed (pipe radius: 50 mm) at 900° C.

Figure 4:
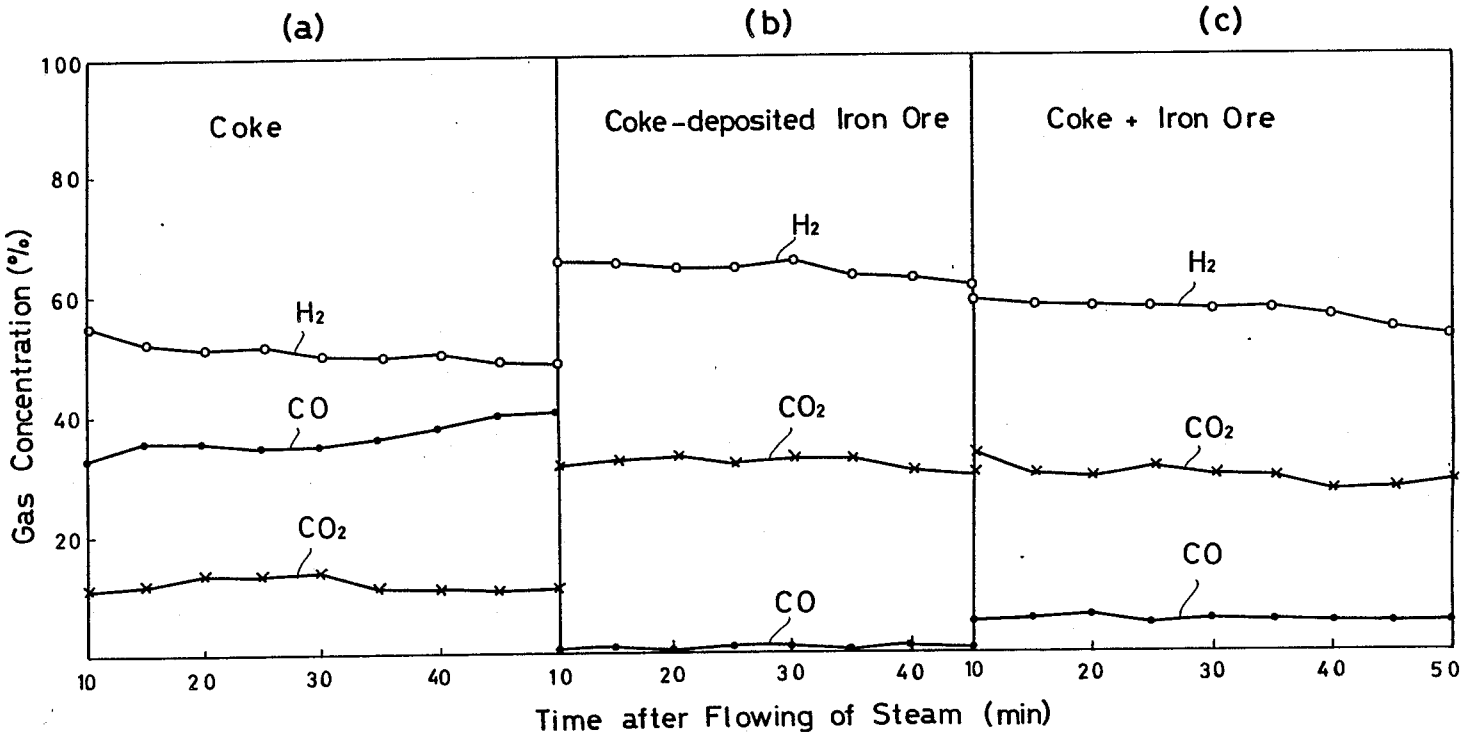
FIG. 4 is a diagram showing experimental results of batch gasification of petroleum coke only (a) and a combination of petroleum coke and iron ore (b, c).

Compositions of gases produced are shown in FIG. 4.

As will be apparent from it, in the case of coke only (a) the rate of CO is overwhelmingly higher as compared with $CO_2$, which implies that shift reaction does not occur so much whereas in the case of the coke-deposited iron ore (b), CO is hardly produced, but is nearly converted into $CO_2$ and the rate of $H_2$ is elevated. Further in case where a mixture of coke and iron ore is gasified (c), the rate of $CO_2$ is higher as compared with CO, which supports that the shift reaction proceeds significantly.

The removal of $CO_2$ from the gases (b) and (c) yielded a high-concentration $H_2$ gas of more than 90%.

This example demonstrates that this invention provides an effective process of gasification for the manufacture of hydrogen.

Example 2

Figure 5:
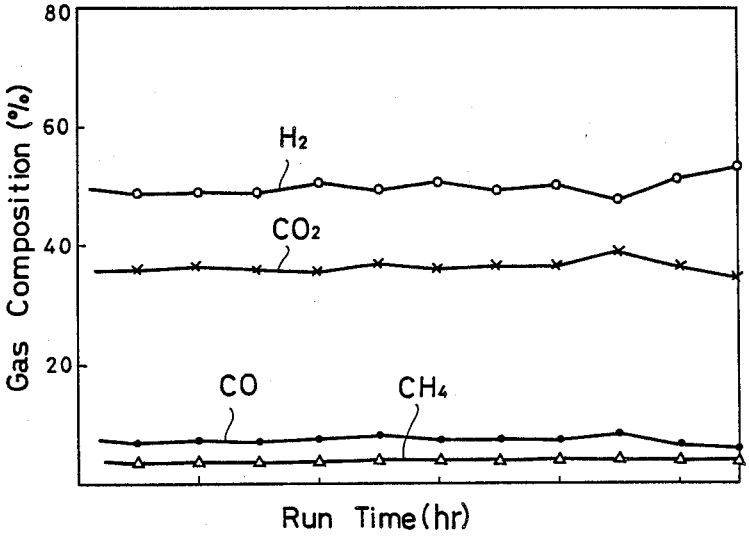
FIG. 5 is a diagram showing composition of gases produced by gasification of coke-deposited iron ore in a continuous fluidized bed.

Gasification of coke-deposited iron ore was conducted using a continuous fluidized bed gasification furnace having a reaction pipe radius of 88 mm under the conditions:

Raw material: iron ore deposited with 14 wt. % of coke
Feed amount of raw material: 10 kg/hr
Reaction temperature: 900° C.
Charge amount of steam: 4.5 kg/hr
Reaction pressure: 5 kg/cm$^2$ G As a result, gas compositions obtained are shown in FIG. 5. According to FIG. 5, gases including about 50% of $H_2$, 33% of $CO_2$, 7% of CO and 4% of $CH_4$ are obtained continuously and securely. When the $CO_2$ was removed by a conventional method of removal of $CO_2$ from the gases, $H_2$ gas having a high concentration of about 75% was obtained efficiently.

As described above, the present invention provides a method of producing reduced iron and light oil from iron ore and heavy oil as raw material which comprises subjecting the heavy oil to thermal cracking by iron ore particles as a fluid medium to produce light oil and during that process, depositing coke obtained as a by-product upon thermal cracking on the surface of the iron ore particles, separating the coke-deposited ore, gasifying the coke to produce a reducing gas and reducing the iron ore by the use of the reducing gas to produce reduced iron. Thus, the reducing agent source can be obtained during the production process and any particular source of reducing agent is unnecessary, which assists in rationalization of process steps. This advantage changes radically the existing concept of location of reduced iron production plant. That is, the location of the plant has heretofore been limited to the districts of occurrence of natural gas as a reducing gas source, but in this invention such limitation can be eliminated utterly. Moreover, the heavy oil used as raw material in this invention is available not only in oil-producing countries, but in crude oil importing countries and its transportation is much easier than transportation of natural gas. Consequently, the location conditions of reduced iron production plant are alleviated to a substantial degree.

Another advantage of this invention is that light oil, worldwide shortage of which is estimated, e.g. kerosene, gas oil can be produced from heavy oil, aiding in obviating the supply-and-demand gap between heavy oil and light oil.

A further advantage is that the reducing gas containing extremely high concentration of $H_2$ gas is obtained in the gasification step in KKI process according to this invention and the $H_2$ gas can be utilized as a reducing agent for KKI process, for upgrading of light and middle oils obtained from heavy oil in KKI process and for any other gasification processes employing hydrogen. Hydrogen has a wide variety of conceivable utilities, for example, as raw material gas in various chemical industries, particularly petroleum industry, coming clear energy, etc. and will increase in demand henceforth.

The gasification of coke by KKI process allows efficient production of hydrogen in the coexistence with iron ore, so that it provides a cheap manufacturing method of hydrogen.

From the viewpoint of efficiency and heat balance of KKI process, the partial oxidation of coke produces easily reducing gas necessary for the reduction of iron ore, the oxidizing gas containing excessive steam to oxygen can oxidize the coke deposited on the iron ore in the thermal cracking step of heavy oil thereby not only to adjust the amount of coke to an amount suitable for reduction step, but to heat the raw material discharged from the thermal cracking step by the heat evolution upon oxidation of the coke and to supply the reduction step with balanced heat. In this way, smooth reaction of KKI process, as a whole, are ensured.

What is claimed is:

1. A method of producing reduced iron and light oil from iron ore and heavy oil as raw materials which comprises:

(a) a thermal cracking step comprising:

feeding heavy oil into a thermal cracking column in which iron ore particles are retained in a fluidized state, subjecting said heavy oil to thermal cracking to produce light oil and depositing coke obtained as a by-product upon thermal cracking on the surface of the iron ore particles;

(b) a gasification step comprising:

introducing said coke-deposited iron ore, which is adjusted such that the residual amount of the coke is 3–6% of the coke-deposited iron ore, into a gasification furnace, and bringing said coke-deposited iron ore into contact with an oxidizing gas substantially containing steam and up to 15 volume %, based on the steam, of oxygen at 800°–1000° C., to react the coke with steam and oxygen, thereby, yielding a reducing gas containing a high-concentration of hydrogen gas; and (c) a reduction step comprising:

transferring heated coke-deposited iron ore and the reducing gas obtained in step (b) to a reduction furnace and reducing the coke-deposited iron ore in a fluidized state at a temperature of at least 800° C. to produce reduced iron ultimately having a coke content of 1 to 3%.

2. The method of producing reduced iron and light oil from iron ore and heavy oil as claimed in claim 1, wherein said raw material iron-ore of step (a) is heated in an ore-heating column disposed along side of said thermal cracking column and fed to the thermal cracking column to supply the heat of cracking reaction of the heavy oil, and the iron ore in that column is returned to the ore-heating column thereby circulating the iron ore between both columns.

3. The method of producing reduced iron and light oil from iron ore and heavy oil as claimed in claim 2, wherein said ore-heating column is supplied with air to burn a part of the coke deposited on the iron ore, whereby the iron ore is heated by the resultant heat evolution.

4. The method of producing reduced iron and light oil from iron ore and heavy oil as claimed in claim 2, wherein said ore-heating column is supplied with a high-temperature combustion gas thereby to heat the iron ore.

5. The method of producing reduced iron and light oil from iron ore and heavy oil as claimed in claim 2, wherein said coke-deposited iron ore in said step (a) is discharged from the thermal cracking column before introducing in the gasification furnace of said step (b).

6. The method of producing reduced iron and light oil from iron ore and heavy oil as claimed in claim 2, wherein said coke-deposited iron ore in step (a) is discharged from the ore-heating column before introducing in the gasification furnace in step (b).

7. The method of producing reduced iron and light oil from ore or heavy oil as claimed in claim 1, wherein in step (a), said iron ore particles have an average particle size of 10 μm–2 mm and said coke as a by-product is deposited in an amount of 10–40 wt % to the iron ore.

8. The method of producing reduced iron and light oil from iron ore and heavy oil as claimed in claim 7, wherein said average particle size of iron ore particles is 20 μm –300 μm.

9. The method of producing reduced iron and light oil from iron ore and heavy oil as claimed in claim 1, wherein said gasification step (b) is conducted under an internal furnace pressure of 0–10 kg/cm$^2$ G.

10. The method of producing reduced iron and light oil from iron ore and heavy oil as claimed in claim 9, wherein said internal furnace pressure is 3–10 kg/cm$^2$ G.

11. The method of producing reduced iron and light oil from iron ore and heavy oil as claimed in claim 1, wherein said oxidizing gas contains at least 90 vol. % of steam.

12. The method of producing reduced iron and light oil from iron ore and heavy oil as claimed in claim 1, wherein said oxidizing gas is flowed through said fluidized bed gasification furnace so that it has a superficial velocity of the fluid gas of 20–200 cm/sec.

13. The method of producing reduced iron and light oil from iron ore and heavy oil as claimed in claim 12, wherein said oxidizing gas has a superficial velocity of the fluid gas of 30–80 cm/sec.

* * * * *